US005772948A

United States Patent [19]

Chenoweth

[11] Patent Number: 5,772,948

[45] Date of Patent: Jun. 30, 1998

[54] MELT-BLOWN FIBER SYSTEM WITH PIVOTAL OSCILLATING MEMBER AND CORRESPONDING METHOD

[75] Inventor: Vaughn Charles Chenoweth, Coldwater, Mich.

[73] Assignee: PlastaFlex Corporation, Battle Creek, Mich.

[21] Appl. No.: 751,826

[22] Filed: Nov. 19, 1996

[51] Int. Cl.[6] ..... D01D 5/08; D02G 3/00

[52] U.S. Cl. ..... 264/444; 264/70; 264/103; 264/211.14; 264/555; 425/72.2; 425/174.2; 425/382.2; 425/464

[58] Field of Search ..... 264/70, 103, 211.14, 264/444, 555; 425/72.2, 174.2, 382.2, 464

[56] References Cited

U.S. PATENT DOCUMENTS

| | | | |
|---|---|---|---|
| 3,491,928 | 1/1970 | Boultinghouse | 225/3 |
| 3,752,613 | 8/1973 | Vogt et al. | 425/224 |
| 3,969,472 | 7/1976 | Driscoll | 264/50 |
| 4,046,538 | 9/1977 | Thomas | 65/475 |
| 4,131,664 | 12/1978 | Flowers et al. | 264/510 |
| 4,223,059 | 9/1980 | Schwarz | 428/198 |
| 4,258,094 | 3/1981 | Benedyk | 428/85 |
| 4,258,097 | 3/1981 | Benedyk | 428/219 |
| 4,380,570 | 4/1983 | Schwarz | 442/350 |
| 4,416,936 | 11/1983 | Erickson et al. | 442/405 |
| 4,612,228 | 9/1986 | Kato et al. | 428/151 |
| 4,910,064 | 3/1990 | Sabee | 428/113 |
| 5,045,271 | 9/1991 | Mente et al. | 264/555 |
| 5,057,168 | 10/1991 | Muncrief | 156/62.6 |
| 5,068,068 | 11/1991 | Furusawa et al. | 264/407 |
| 5,075,068 | 12/1991 | Milligan et al. | 264/555 |
| 5,132,549 | 7/1992 | Allan et al. | 264/70 |
| 5,268,015 | 12/1993 | Furtak et al. | 65/447 |
| 5,373,610 | 12/1994 | Jean et al. | 19/163 |
| 5,475,903 | 12/1995 | Collins | 28/104 |
| 5,476,616 | 12/1995 | Schwarz | 264/6 |
| 5,603,743 | 2/1997 | Aschenbeck et al. | 65/458 |

*Primary Examiner*—Leo B. Tentoni
*Attorney, Agent, or Firm*—Myers Liniak & Berenato

[57] ABSTRACT

A melt-blowing system and corresponding method are provided for making a nonwoven polymer filament blanket. Subsequent to formation and blowing of the polymer filaments toward a receiving conveyor, a pivoting oscillating member is provided through which the filaments are blown. Vertical oscillation of the oscillating member causes the flow direction of the filament stream to vertically oscillate thereby increasing the tensile strength of the nonwoven blanket in the in-line direction as a substantial number of the filaments become oriented in the in-line direction on the conveyor.

18 Claims, 5 Drawing Sheets

MELT-BLOWN FIBER SYSTEM WITH PIVOTAL OSCILLATING MEMBER AND CORRESPONDING METHOD

This invention relates to a melt-blown polymer fiber system and corresponding method for making polymer fiber-based insulating, stuffing, and/or padding materials. More particularly, this invention relates to a melt-blown system including a pivotal oscillating member located downstream of the die and spinnerette for orienting a plurality of the melt-blown fibers in the machine direction (i.e. "in-line" direction) on the receiving conveyor in order to increase the tensile strength of the resulting product in that direction. According to certain embodiments, the invention relates to a system and method for reducing the width of the collected blanket or mat.

BACKGROUND OF THE INVENTION

Melt-blown polymer systems and corresponding methods of manufacture are old and well-known in the art. For example, see U.S. Pat. Nos. 4,380,570; 4,223,059; 5,075,068, and 5,476,616, the entire disclosures of which are hereby incorporated herein by reference.

Prior art FIG. 1 is a partially schematic side cross-sectional view of a conventional spinnerette assembly, while prior art FIG. 2 is a front cross-sectional view illustrating the spinning nozzles and surrounding air or gas apertures. As shown, the melt-blowing system of FIGS. 1–2 includes melt-blowing spinnerette assembly 1 mounted on die body 3. From an extruder (see FIG. 3), polymer melt (e.g. molten polypropylene) is supplied to die 3 and therefrom via passage 5 to cavity 7 which is defined in the end of die 3. From cavity 7, the polymer melt flows to and through hollow spinning nozzles 11 which are mounted in the spinnerette body plate and extend through air or gas cavity 9. Air and/or gas under pressure enters the spinnerette assembly through inlet port 15 and flows into cavity 9 by way of slot 13.

Hollow filament forming nozzles 11 extend through plate 17 via tight openings 19. Plate 21 and spacers 23 are provided and define cavity 25 between plates 17 and 21. From cavity 9, the pressurized air or gas flows through apertures 27 in plate 17 and into cavity 25. From cavity 25, the air and/or gas flows outward 20 around nozzles 11 via circular holes 29 and 31 formed in plates 21 and 33 respectively. As shown in FIG. 1, as formed polymer fibers 35 (e.g. polypropylene filaments) exit elongated nozzles 11, they are blown outwardly by the air 20 from holes 31, and thereafter are collected on a moving receiver surface in the path of the fiber stream in order to form a nonwoven mat, the receiver surface typically being a conveyor belt or drum screen in certain instances. FIG. 2 illustrates circular apertures 29 through which the air is blown adjacent the periphery of nozzles 11.

Prior art FIG. 3 is a partially schematic cross-sectional view of another conventional die assembly for polymer melt-blown applications. As shown, this conventional polymer melt blowing system includes polymer extruder 41, hollow tube 42 as part of the die, thermocouples 43 for measuring the temperature of the molten polymer in passage 56, and a spinnerette or nozzle-assembly 44. Nozzle assembly 44 includes elongated nozzles 45, air and/or gas cavity 46, plates 47 and 48, air pressure gauge 49, resin bleed tube 50 and corresponding valve 51, air inlet 51, air heater 52, air flow meter 53, thermocouple 54, and finally air supply tube 55. Because each nozzle 45 is surrounded by an air hole, a cross-sectional view of the FIG. 3 system near the spinnerette face through plate 47 would look similar to FIG. 2 discussed above.

The molten polymer is supplied from extruder 41 through aperture 56 in the die and thereafter flows into nozzles 45. The fibers are formed and blown out of nozzles 45 onto a conveyor belt or screen by the air or gas from cavity 46. The air which makes its way into cavity 46 via tube 55 is blown out of the cavity via apertures surrounding nozzles 45 thereby functioning to carry the polymer fibers onto the conveyor so as to form a nonwoven continuous polymer-fiber batt or blanket (e.g. see FIG. 2).

Unfortunately, when conventional horizontal melt-blowing systems are used to form nonwoven batts or blankets as discussed above and shown in FIGS. 1–3, the fibers collected on the receiving conveyor often tend to align themselves in a back-and-forth direction (i.e. in the"cross-machine" direction) across the width of the conveyor due to the fiber velocity, air-flow, and speed of the conveyor. As a result of such fiber alignment, the resulting blanket may have about 50% of the tensile strength in the "machine" direction (i.e. along the length of the conveyor) when compared to the higher tensile strength in the "cross-machine" direction (i.e. the direction back and forth across the width of the conveyor belt or screen). In other words, the resulting blanket is much easier to pull apart lengthwise than in the width-wise direction.

The tensile strength problem along the length of the resulting blanket is magnified in high loft, low density applications when the resulting blanket has a density, for example, of about one pound per cubic foot. Due to such tensile strength problems in the"machine" direction, additional thermal or chemical bonding of the collected fibers would be needed in order to provide the blanket with a suitable tensile strength in both directions for many applications.

U.S. Pat. No. 5,045,271 discloses a process for producing irregular nonwoven sheets using a draw-off device and a spreading device. Unfortunately, the disclosure of the '271 patent is silent regarding the problems set forth above relating to horizontal blowing systems and tensile strengths of the resulting product in all directions.

It is apparent from the above that there exists a need in the art for a low cost and simple system and corresponding method for improving the tensile strength of melt-blown polymer blankets in the "machine" or "in-line" direction.

It is the purpose of this invention to fulfill the above-described needs in the art, as well as other needs which will become apparent to the skilled artisan from the following detailed description of this invention.

SUMMARY OF THE INVENTION

Generally speaking, this invention fulfills the above-described needs in the art by providing a melt blowing method of making a non-woven blanket of elongated polymer filaments or fibers, the method comprising the steps of:

extruding a polymer and causing molten polymer material to travel through a die in a plurality of nozzles so as to form a plurality of elongated polymer filaments or fibers;

blowing the polymer filaments substantially horizontally through a cavity defined in an oscillating member toward a moving conveyor surface; and vertically oscillating the oscillating member thereby redirecting the filaments as they pass through the cavity so as to improve the tensile strength of the resulting blanket that is formed on the moving conveyor surface in the in-line direction.

This invention still further fulfills the above-described needs in the art by providing a melt blowing system for making blankets of polymer filaments, the melt blowing system comprising:

an extruder for providing molten polymer to a spinnerette;

the spinnerette including a plurality of nozzles for forming polymer filaments and for permitting an air or gas under under pressure to blow a stream of the polymer filaments substantially horizontally toward a receiving surface; and an oscillating member located between the spinnerette and the receiving surface, the oscillating member vertically oscillating so that a flow direction of the stream of polymer filaments vertically oscillates as the stream is blown toward the receiving surface.

This invention still further fulfills the above-described needs in the art by providing a method of making a blanket of non-woven polymer filaments, the method comprising the steps of:

melt blowing a plurality of polymer filaments toward a moving receiving surface;

providing an oscillating member through which the filaments are blown; and pivotally oscillating the oscillating member about a pivot axis as the filaments are blown therethrough so as to improve the tensile strength of the blanket in the in-line direction.

IN THE DRAWINGS

Figure 4:
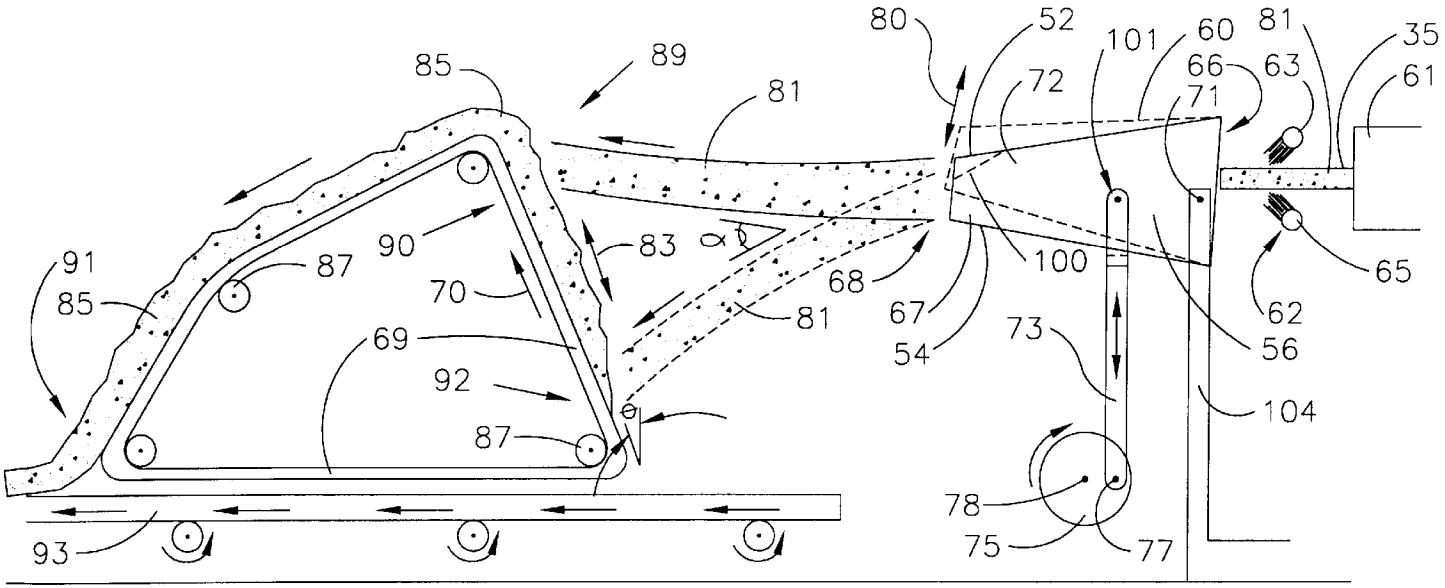

FIG. 4 is a partial schematic side view of a polymer melt-blowing system and corresponding method according to certain embodiments of this invention, the system including a pivotal oscillating member which through its vertical oscillating movement distributes the continuous polymer fibers upward and downward on the receiving conveyor screen thereby improving the tensile strength of the resulting blanket in the machine or in-line direction.

Figure 5:
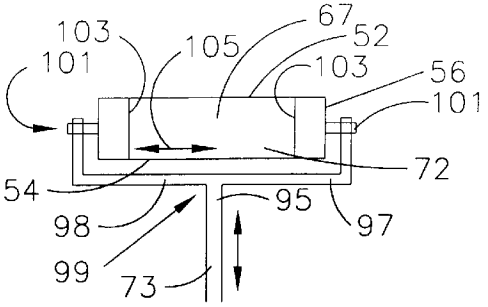

FIG. 5 is a front elevational view of the hollow or tubular oscillating member of FIG. 4.

Figure 6:
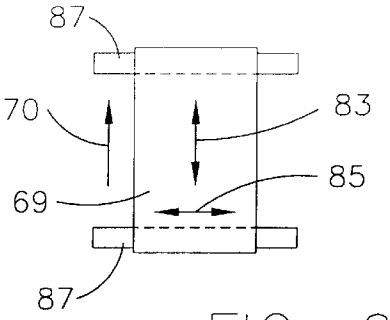

FIG. 6 is an elevational view illustrating the conveyor screen of FIG. 4 from the point of view of the oscillating member, this figure showing the perpendicular relation between the "machine" (in-line) and "cross-machine" directions discussed herein.

Figure 7:
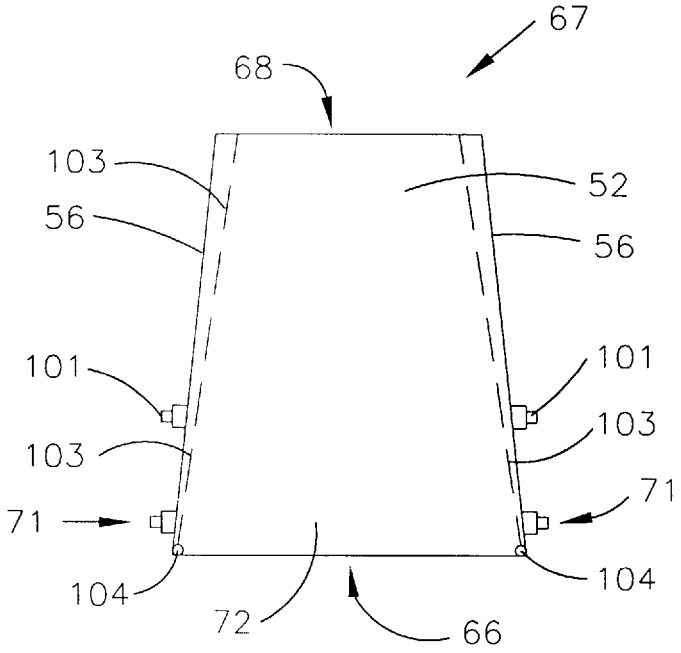

FIG. 7 is a top elevational view of the oscillating member of FIGS. 4–5.

Figure 8:
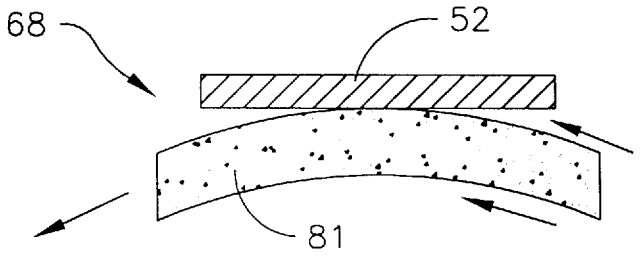

FIG. 8 is a side cross-sectional view of the top plate or wall of the oscillating member redirecting the plastic fiber stream as it exits the oscillating member and is blown toward the receiving conveyor. If this figure is inverted, it would illustrate the bottom wall redirecting the plastic fiber stream.

DETAILED DESCRIPTION OF CERTAIN EMBODIMENTS OF THIS INVENTION

Referring now more particularly to the accompanying drawings in which like reference numerals indicate like parts throughout the several views.

Figure 1:
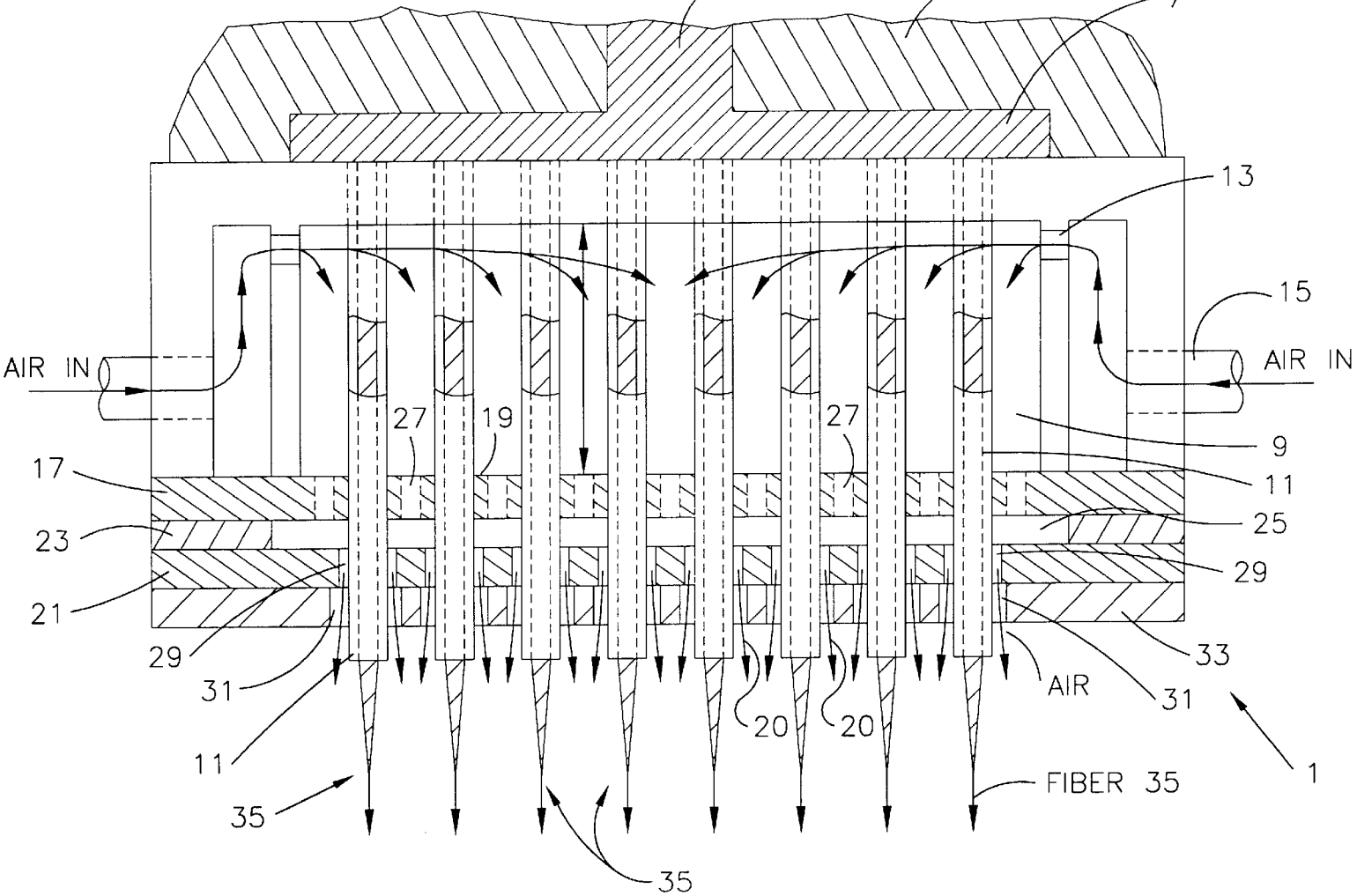
FIG. 1 (Prior Art)
FIG. 1 is a partially schematic side cross-sectional view of a prior art melt-blowing spinnerette and die assembly.
Figure 2:
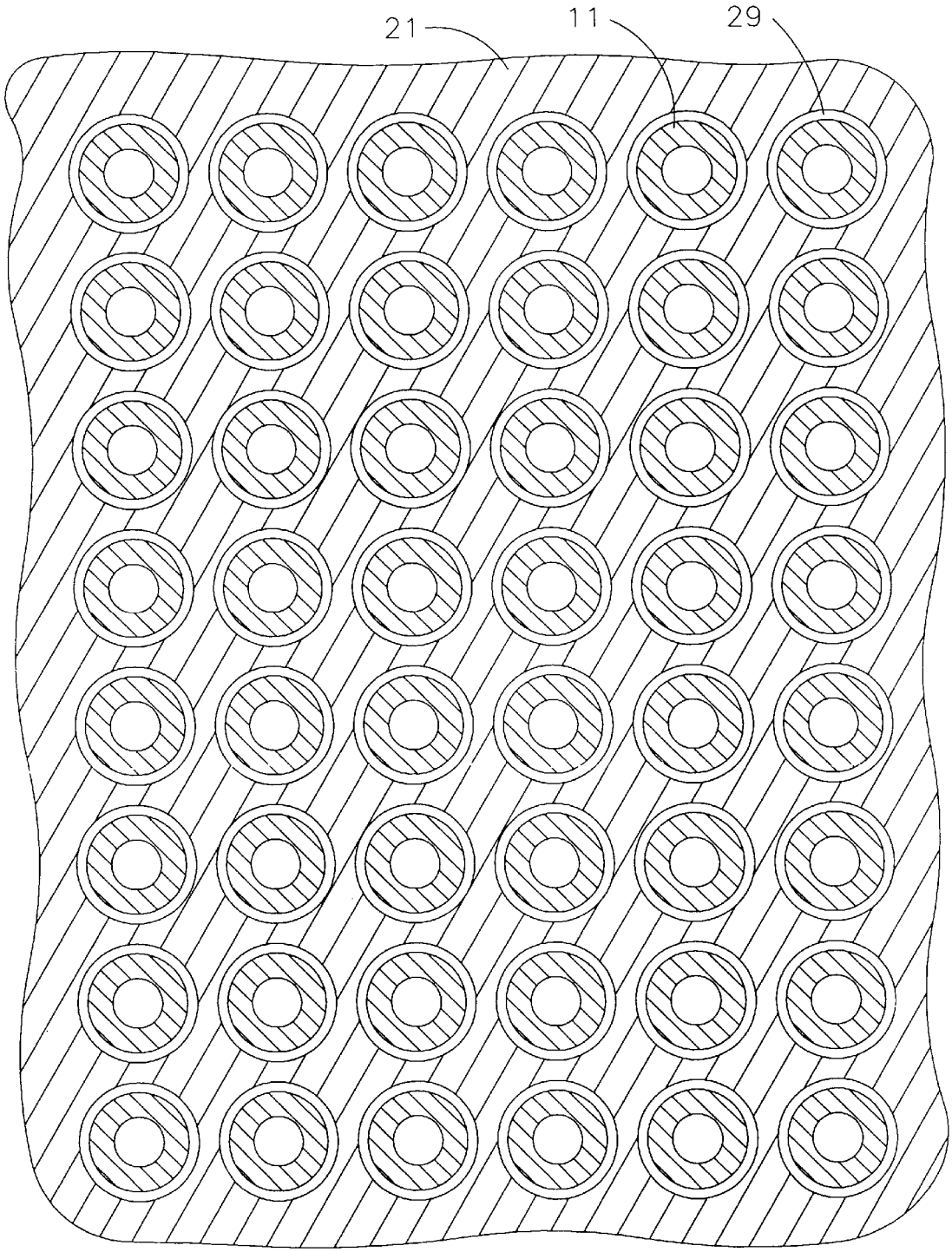
FIG. 2 (Prior Art)
FIG. 2 is a front cross-sectional view of the prior art spinnerette face of FIG. 1.
Figure 3:
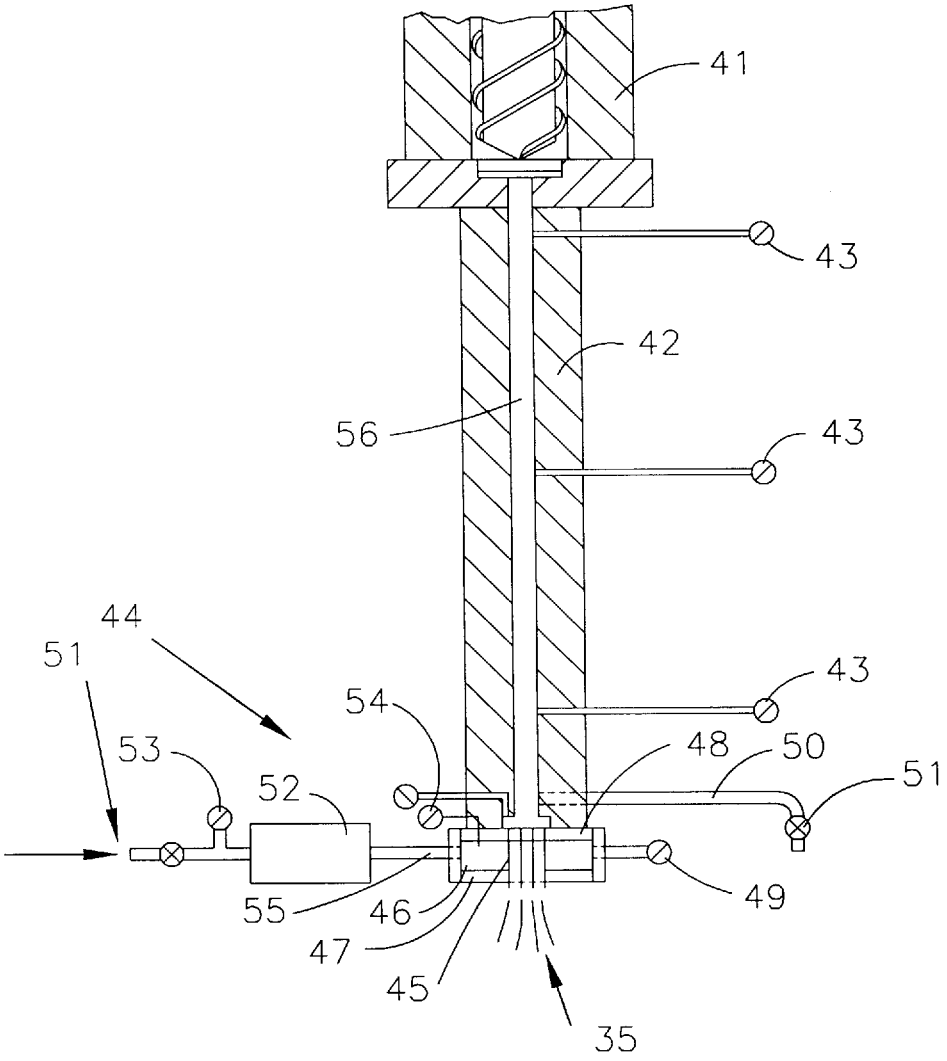
FIG. 3 (Prior Art)
FIG. 3 is a partially schematic cross-sectional view of another prior art melt-blowing assembly.

FIG. 4 is a partial schematic side elevational view of a horizontally aligned polymer fiber melt-blowing system and corresponding method according to certain embodiments of this invention. As shown, the system and method begin with conventional forming of continuous polymer (e.g. polypropylene or polyethylene) fibers or filaments at melt-blower 61. Melt blower is representative, for example, of either the conventional polymer extruder, die 3, and spinnerette 1 of FIGS. 1–2, or the conventional polymer extruder 41, die, and spinnerette of FIG. 3. In either event, substantially continuous and unbroken polymer filaments 35 are conventionally extruded, flow through the die, formed, and blown from the spinnerette toward the conveyor in a substantially horizontal direction (i.e. horizontal ± about 45°, preferably horizontal ± about 20°) from melt-blowing station 61.

After continuous polymer filaments 35 are formed and blown from the spinnerette at station 61, they pass between elongated quenching tubes 63 and 65 which function to direct pressurized water and/or air 62 onto melt-blown fibers 35 as they pass therebetween. The water and/or air 62 blown onto fibers 35 through spaced holes in elongated tubes 63 and 65 functions to quench or cool the heated polymer fibers so that they do not fuse completely together when they reach and settle on the surface of receiving conveyor 69. The point at which the air/water mixture from tubes 63 and 65 hits the polymer fiber stream is at least about 3.0 inches from the die block or spinnerette face (e.g. about 3.25 inches).

After melt-blown fibers 35 leave station 61 and are quenched via the air/water from tubes 63 and 65, the fibers proceed into inlet 66 of hollow pivoting and oscillating member 67. Oscillating member includes top wall 52, bottom wall 54, and sidewalls 56 between which the fiber stream flows, and is pivotally connected to rigid frame 104 at substantially horizontal pivot point or pin 71. The output end of member 67 oscillates vertically (i.e. up and down) 80 about pivot axis 71 as member 67 is driven upward and downward by and along with elongated bar or yoke 73 which is attached to driven gear 75. Yoke 73 is attached to member 67 at pivot pin 101. As member 67 vertically and pivotally oscillates, fiber stream 81 is redirected as it contacts top and/or bottom walls 52 and 54, respectively. FIG. 4 shows in dotted lines 60 the outline of member 67 in a position pivoted vertically upward from its otherwise illustrated position, this dotted line 60 position occurring at a point during the oscillation.

As shown, yoke 73 is pivotally attached to gear 75 at pivot point 77 so that as gear 75 is driven by a motor (not shown) about axis 78 in a clockwise (or counterclockwise) direction, yoke 73 is caused to move upward and downward thereby causing member 67 to vertically oscillate and pivot about axis 71 so as to redirect fiber stream 81 upward and downward as it moves toward the surface of receiving conveyor. Assuming clockwise rotation of circular gear 75, for example, when pivot pin connection 77 is on the right side of gear axis 78 and moving downward (as in FIG. 4), yoke 73 and oscillating member 67 are also moving downward therewith, with member 67 pivoting about axis 71 during such movement. Accordingly, when connection 77 rotates to the left side of axis 78, yoke 73 and member 67 are moving upward during the clockwise rotation of gear 75.

According to certain alternative embodiments, gear 75 may be replaced with a hydraulically driven piston assembly for moving member 67 upward and downward about point 71.

As a result of this vertical pivoting oscillation of hollow forming member 67 about axis 71, polymer fiber stream 81, as it is blown substantially horizontally from station 61 and directed toward moving conveyor screen 69, is redirected by member 67 and oscillated upward and downward along upward moving conveyor surface 69 so as to cause a substantial number of the polymer fibers or filaments to become at least partially oriented in the "machine" or "in-line" direction 83 so as to improve the tensile strength of the resulting mat or blanket 85 in direction 83. Fiber stream 81 is directed substantially horizontally toward the conveyor from the output of member 67 (i.e. horizontal ± about 40° due to the oscillation of the output end of member 67). The oscillation of member 67 causes the filament stream 81 to vertically oscillate over a total angle $\propto$ of at least about 15° as the filaments are directed toward the conveyor, more preferably over an angle $\propto$ of at least about 20°, and most preferably of about 23°. This represents an improvement over the prior art where the fibers tend to become aligned in "cross machine" direction 85 on the conveyor.

The density of the resulting polymer fiber (e.g. polypropylene) blanket 85 is from about 0.25 to 2.0 lb./ft.$^3$ in certain embodiments, preferably less than about 1.5 lb./ft$^3$, and most preferably from about 0.5 to 1.0 lb./ft.$^3$. Blanket 85 may be used for sound insulation, stuffing material, void filler, thermal insulation, etc. and may be packaged in rolls or the like.

The filament receiver system of FIG. 4 includes endless driven conveyor belt or screen 69 supported and driven by a plurality of rollers 87. After fiber stream 81 impinges and settles upon the surface of conveyor 69, the resulting blanket (i.e. mat or batt) 85 is formed thereon and moved along conveyor 69 to point 91 where the blanket is fed onto substantially horizontal continuous or endless conveyor 93 for further processing such as packaging and the like.

In the fiber stream 81 receiving area, the surface of conveyor 69 moves substantially upward at an angle $\theta$ relative to the vertical. Angle $\theta$ may be from about 0° to 60° according to certain embodiments of this invention and is preferably about 30°. Additionally, the receiving surface of conveyor 69 may be located from about 5–8 feet from the discharge end of member 67 and moves at a speed of from about 5 to 100 feet per minute (FPM).

FIG. 5 is a front elevational view of the FIG. 4 yoke 73 and member 67 from the point of view in FIG. 4 of conveyor 69. As shown, upward and downward moving yoke 73 includes vertical rigid bar member 95 which extends upwardly from gear 75. Yoke 73 includes branches 97 and 98 which extend in opposite horizontal directions from member 95 at junction 99. Each of rigid branches 97 and 98 is pivotally attached to a different side of oscillating member 67 via a pivot pin 101 about which yoke 73 pivots relative to the body of member 67.

FIG. 5 also illustrates cavity or thru-way 72 defined between walls of member 67. Walls of forming tube 67 may be adjusted so as to alter the shape (e.g. width) of fiber stream 81 as it exits member 67 and is blown toward conveyor 69. As shown, member 67 includes two adjustable side plates or walls 103. By adjusting 105 the position of pivotally mounted plates 103 relative to the fixed rigid sides 56 of member 67, the width of fiber stream 81 exiting member 67 can be varied so as to accommodate different applications and/or different conveyors 69. Instead of being pivotally mounted, side plates 103 may be adjusted in direction 105 on a track (not shown) or the like using screws or their equivalent to secure them in the desired position within cavity 72 of member 67.

FIG. 6 is an elevational view of conveyor 69, which moves substantially upward in direction 70, as viewed from oscillating member 67, this view illustrating "machine" or "in-line" direction 83 along the length of conveyor 69, and "cross-machine" direction 85 across the width of conveyor 69. Direction 83 is parallel to direction 70. Surprisingly, it has been found that, due to the provision of oscillating member 67, the tensile strength of blanket 85 in direction 83 is almost as great as the strength in direction 85.

FIG. 7 is a top elevational view of oscillating member 67. Viewed from the top, member 67 includes input end 66, fiber output end 68, adjustable side plates 103, and side projections or pins 71 and 101 for allowing pivotal attachment to frame 104 and yoke 73, respectively. Each of the two side plates 103 is pivotally mounted on fixed axis 104, with each axis or pin 104 being located at the input end 66 of member 67. Accordingly, pivotally mounted side plates 103 provide a means for adjusting the width of the mat 85 collected on conveyor 69. When pivoted about axes 104, plates 103 move such that their respective output ends, near end 68 of member 67, move relative to fixed sidewalls 56 so as to compress or expand the width of the fiber stream exiting member 67. As shown, the exit end or opening 68 of member 67 is smaller than the input end. The position of projections 71 remains fixed relative to frame 104 although member 67 pivots up and down about these projections 71.

Within member 67, elongated cavity 72 is defined and extends between fiber input end 66 and output end 68 so as to allow the fiber stream 35, 81 to flow through member 67 and be redirected and distributed in a vertically oscillating manner on the receiving conveyor.

Instead of being completely enclosed by sidewalls and top and bottom walls as shown, cavity 72 may only be defined by two or three walls according to certain embodiments. For example, member 67 need not have sidewalls. Alternatively, member 67 may include three walls with one of the upper and lower walls, 52 and 54, being left out according to certain embodiments. Regardless of the shape of member 67, what is important is that the oscillation of member 67 oscillate the direction of stream 81 as it is blown toward conveyor 69 so that the tensile strength of the resulting blanket 85 is improved in direction 83.

According to certain other embodiments, member 67 may have an adjustable top (or bottom) plate or hinged deflector 100 that functions to adjust the height of the fiber stream 81 leaving the output end of member 67. Such a deflector is to be positioned at the output end 68 of member 67 and attached to either the top or bottom wall.

According to certain embodiments, member 67 oscillates up and down at a rate less than about 100 complete cycles per minute, and preferably less than about 60 cycles per minute. According to preferred embodiments, member 67 oscillates at a rate of from about 10–35 complete cycles per minute, more preferably from about 20–30 complete cycles per minute, and most preferably about 25 complete cycles per minute. A complete cycle is defined by one complete 36° revolution of gear 75. In other words, a complete oscillation cycle of member 67 may be defined by member 67 starting at its lowest possible point (i.e. where it directs stream 81 to location 92 on the conveyor) and being moved upward by yoke 73 to the vertically highest pivotal point and then all the way back down to its starting point. This is one cycle (i.e. the beginning and end of the cycle ending at the same position of member 67).

The output end of member 67 may be located about 5–10 feet from the conveyor 69 surface, and the total vertical travel of output end 68 of member 67 may be from about 8–15 inches (preferably about 11 inches) given a total length of member 67 from its input end to its output end of about 30 inches. Dimensions of the height and width of the input end are determined by the dimensions of the spinnettes. The ratio of input end cross-sectional area to the output end cross-sectional area will be similar for variously sized spinnerettes, within the range of from about 1.50:1 to 2.25:1, preferably about 1.75:1. For example, the input end 66 of member 67 may be about 22 inches wide and output end 68 about 24 inches wide according to certain embodiments. Input end 66 may have a height (see FIG. 4) of about 14 inches and output end 68 a height of about 7 inches according to certain embodiments. Sheet metal may be used to make member 67.

A typical operation of the instant invention will now be described, although this invention should not be construed as being limited thereto. Firstly, a polymer such as polypropylene (e.g. in pellet form) is loaded into extruder 41. From the extruder, the polypropylene, in molten form, is forwarded through the die (3, 42) at a flow rate of from about 150 to 250 lb./hr., preferably about 200 lb./hr., and a temperature of from about 400°–500° F., preferably about 450° F., and into the spinnerette nozzles 11. Each spinnerette nozzle (11 or 45) outputs a substantially continuous and unbroken polypropylene fiber 35 which is blown by the surrounding air leaving the spinnerette substantially horizontally toward both oscillating member 67 and receiving conveyor 69 at a speed or velocity of from about 200 to 700 feet per minute (FPM) so as to form a stream 81 of fibers 35. After the polypropylene fibers have been formed and blown out of the die and spinnerette at a fiber diameter average of from about 3 microns to 10 microns, they are quenched by water and/or air 62 directed from pipes 63 and 65 on either side of the fiber stream so that the fibers 35 do not totally fuse together when they hit the surface of conveyor 69. According to certain alternative embodiments, the system may be arranged to blow out the fiber stream vertically downward or angled downward, onto a receiving conveyor 69.

After being quenched, fiber stream 81 enters input end 66 of pivotal oscillating member 67 and flows through cavity 72 defined therein. Meanwhile, gear 75 (or its hydraulic equivalent) is being driven by an external motor thereby oscillating yoke 73 upward and downward, thereby causing output end 68 of member 67 to vertically oscillate about pivot axis 71 so that fiber stream 81 is redirected and its landing position on the conveyor oscillating both vertically and horizontally due to the conveyor's angle θ of incline. As a result of this oscillation, the fibers 35 within stream 81 are collected on conveyor 69 and oriented in a manner such that a substantial number of the fibers are oriented in approximately direction 83 thereby improving the tensile strength of the resulting blanket 85 in that direction.

For example, assume that output end 68 of member 67 begins in its vertically lowermost position. At this position, it is directing fiber stream 81 toward the lower portion 92 of conveyor 69 (this is shown in dotted lines in FIG. 4). From this lowermost position, the output end of member 67 pivots upward about axis 71 thereby causing stream 81 to be redirected upwardly along the surface of receiving conveyor 69 until the stream is hitting or landing on the conveyor surface at 90. Thereafter, as a result of the oscillation, output end 68 pivots downward causing the fibers to impinge upon the conveyor surface at substantially all surface locations between locations 90 and 92 until the fibers are again hitting the surface at 92. As gear 75 is driven, this process is repeated over and over with the result being improved tensile strength in direction 83 of blanket 85.

After fiber stream 81 is collected on the surface of conveyor 69, the conveyor, driven by rollers 87, forwards blanket 85 until it slides off of conveyor 69 onto endless conveyor 93. From here, nonwoven fiber blanket 85 is forwarded for further processing, such as packaging and the like.

Conveyor 69 moves on rollers 87 at a substantially constant speed of from about 5 to 100 feet per minute (FPM). The speed of conveyor 69 is variable. Meanwhile, conveyor 93 travels at a speed similar to that of conveyor 69 vertically below conveyor 69, of from about 5 to 100 FPM.

Once given the above disclosure, therefore, various other modifications, features, or improvements will become apparent to the skilled artisan. Such other features, modifications, and improvements are thus considered a part of this invention, the scope of which is to be determined by the following claims.

I claim:

1. A melt-blowing method of making a nonwoven blanket of elongated polymer filaments or fibers, the method comprising the steps of:

extruding a polymer and causing molten polymer material to travel through a die and a plurality of nozzles so as to form a plurality of elongated polymer filaments or fibers;

blowing the polymer filaments or fibers substantially horizontally through a cavity defined in an oscillating member toward a moving conveyor surface so as to form the nonwoven blanket;

vertically oscillating the oscillating member thereby redirecting the filaments or fibers as they pass through the cavity so as to improve the tensile strength of the resulting blanket that is formed on the moving conveyor surface in the in-line direction; and moving the conveyor surface upward at an angle θ to the vertical so that the landing position of the redirected filaments on the conveyor oscillates.

2. A melt-blowing method of making a blanket of elongated polymer filaments or fibers, the method comprising the steps of:

extruding a polymer and causing molten polymer material to travel through a die and a plurality of nozzles so as to form a plurality of elongated polymer filaments or fibers;

blowing the polymer filaments or fibers substantially horizontally through a cavity defined in an oscillating member toward a moving conveyor surface;

vertically oscillating the oscillating member thereby redirecting the filaments or fibers as they pass through the cavity so as to improve the tensile strength of the resulting blanket that is formed on the moving conveyor surface in the in-line direction; and wherein said blowing step includes blowing the filaments horizontally ± about 20°.

3. A melt-blowing method of making a blanket of elongated polymer filaments, the method comprising the steps of:

extruding a polymer and causing molten polymer material to travel through a die and a plurality of nozzles so as to form a plurality of elongated polymer filaments;

blowing the polymer filaments substantially horizontally through a cavity defined in an oscillating member toward a moving conveyor surface so as to form the blanket;

vertically oscillating the oscillating member thereby redirecting the filaments as they pass through the cavity; and wherein said oscillating step includes causing the oscillating member to pivot about a substantially horizontal pivot axis.

4. A melt-blowing method of making a blanket of elongated polymer filaments, the method comprising the steps of:

extruding a polymer and causing molten polymer material to travel through a die and a plurality of nozzles so as to form a plurality of elongated polymer filaments;

blowing the polymer filaments substantially horizontally through a cavity defined in an oscillating member toward a moving conveyor surface so as to form the blanket;

vertically oscillating the oscillating member thereby redirecting the filaments as they pass through the cavity so as to improve the tensile strength of the resulting blanket that is formed on the moving conveyor surface in the in-line direction; and adjusting the position of a pair of pivotally mounted side plates or walls of the oscillating member so as to adjust the width of the non-woven blanket, and wherein the oscillating member also includes a top wall and a bottom wall that define the cavity therebetween.

5. A melt-blowing method of making a blanket of elongated polymer filaments, the method comprising the steps of:

extruding a polymer and causing molten polymer material to travel through a die and a plurality of nozzles so as to form a plurality of elongated polymer filaments;

blowing the polymer filaments substantially horizontally through a cavity defined in an oscillating member toward a moving conveyor surface so as to form the blanket;

vertically oscillating the oscillating member thereby redirecting the filaments as they pass through the cavity; and said oscillating step causing the direction in which the filaments are blown to be vertically oscillated over an angle $\propto$ of at least about 10° as the filaments are blown toward the conveyor surface.

6. A melt-blowing method of making a blanket of elongated polymer filaments or fibers, the method comprising the steps of:

causing molten polymer material to travel through a die and a plurality of nozzles so as to form a plurality of elongated polymer filaments or fibers;

blowing the polymer filaments or fibers substantially horizontally through a cavity defined in an oscillating member toward a moving conveyor surface in order to form the blanket;

vertically oscillating the oscillating member thereby redirecting the filaments or fibers as they pass through the cavity so as to improve the tensile strength of the resulting blanket that is formed on the moving conveyor surface in the in-line direction; and oscillating the oscillating member at a rate of at least about 10 cycles per minute.

7. A melt-blowing method of making a blanket of elongated polymer filaments, the method comprising the steps of:

forming a plurality of elongated polymer filaments;

blowing the polymer filaments substantially horizontally through a cavity defined in an oscillating member toward a moving conveyor surface in order to form the blanket;

oscillating the oscillating member about a pivot axis thereby redirecting the filaments as they pass through the cavity so as to improve the tensile strength of the resulting blanket that is formed on the moving conveyor surface; and oscillating the oscillating member at a rate of from about 10–35 cycles per minute.

8. A melt-blowing method of making a blanket of elongated polymer filaments, the method comprising the steps of:

causing molten polymer material to travel through a die and a plurality of nozzles so as to form a plurality of elongated polymer filaments;

blowing the polymer filaments substantially horizontally through a cavity defined in an oscillating member toward a moving conveyor surface in order to form the blanket;

pivotally oscillating the oscillating member about a pivot axis thereby redirecting the filaments as they pass through the cavity so as to improve the strength of the resulting blanket that is formed on the moving conveyor surface; and pivotally oscillating the oscillating member at a rate of less than about 100 cycles per minute.

9. A melt-blowing method of making a blanket of elongated polymer filaments or fibers, the method comprising the steps of:

extruding a polymer and causing molten polymer material to travel through a die and a plurality of nozzles so as to form a plurality of elongated polymer filaments or fibers;

blowing the polymer filaments or fibers substantially horizontally through a cavity defined in an oscillating member toward a moving conveyor surface in order to form the blanket;

vertically oscillating the oscillating member thereby redirecting the filaments or fibers as they pass through the cavity so as to improve the tensile strength of the resulting blanket that is formed on the moving conveyor surface in the in-line direction; and causing a substantially horizontally aligned wall of the oscillating member to contact, and thus redirect a travel direction of, the filaments or fibers during said oscillating step so that a stream of the filaments or fibers vertically oscillates over an angle $\propto$.

10. A melt-blowing system for making a blanket of polymer filaments, the melt-blowing system comprising: an extruder for providing molten polymer to a spinnerette;

said spinnerette including a plurality of nozzles for forming polymer filaments and for permitting an air or gas under pressure to blow a stream of the polymer filaments substantially horizontally toward a receiving surface in order to form the blanket;

an oscillating member located between said spinnerette and said receiving surface, said oscillating member vertically oscillating so that a flow direction of the stream of polymer filaments vertically oscillates as the stream is blown toward said receiving surface;

wherein said oscillating member includes an input end, an output end, and a cavity disposed between said input and output ends, and wherein the stream flows through said cavity; and wherein said oscillating member oscillates at a rate of less than about 100 cycles per minute.

11. The method of claim 2, wherein the rate is less than about 60 cycles per minute.

12. The method of claim 1, wherein angle θ is from about 10°–50° so that the landing position of the filaments on the conveyor oscillates both vertically and horizontally.

13. A melt-blowing system for making blankets of polymer filaments, the melt-blowing system comprising:

an extruder for providing molten polymer to a spinnerette;

said spinnerette including a plurality of nozzles for forming polymer filaments and for permitting an air or gas under pressure to blow a stream of the polymer filaments substantially horizontally toward a receiving surface;

an oscillating member located between said spinnerette and said receiving surface, said oscillating member vertically oscillating so that a flow direction of the stream of polymer filaments vertically oscillates as the stream is blown toward said receiving surface; and a substantiallly horizontal pivot axis, said oscillating member pivoting about said pivot axis during oscillation.

14. The melt-blowing system of claim 13, wherein said oscillating member includes an input end, an output end, and a cavity disposed between said input and output ends, and wherein the stream flows through said cavity.

15. The melt-blowing system of claim 13, wherein said oscillating member oscillates at a rate of less than about 100 cycles per minute.

16. A method of making a nonwoven blanket of polymer filaments, the method coprising the steps of:

melt-blowing a plurality of polymer filaments toward a moving receiving surface to form the nonwoven blanket of polymer filaments;

providing an oscillating member through which the filaments are blown; and pivotally oscillating the oscillating member about a pivot axis as the filaments are blown therethrough so as to improve the tensile strength of the blanket in the in-line direction.

17. The method of claim 16, further comprising the step of adjusting the position of walls of the oscillating member so as to change the size or shape of a stream of the filaments output from the oscillating member.

18. The method of claim 16, further comprising feeding a polymer resin into an extruder and a die, and carrying out the steps recited in claim 16, so that the resulting non-woven blanket of polymer fibers has a density less than about 1.5 lb./ft.$^3$, and an average fiber diameter of from about 3 to 10 microns.

* * * * *